US005350561A

United States Patent [19]

Takamura et al.

[11] Patent Number: 5,350,561

[45] Date of Patent: Sep. 27, 1994

[54] CR-MO STEEL PIPE AND WELDING METHOD THEREOF

[75] Inventors: Toshihiro Takamura; Yukio Nishino; Motoaki Oyama; Akiyoshi Matsushita, all of Kawasaki, Japan

[73] Assignee: NKK Corporation, Tokyo, Japan

[21] Appl. No.: 36,945

[22] Filed: Mar. 25, 1993

[30] Foreign Application Priority Data

Mar. 31, 1992 [JP] Japan ..... 4-103768

[51] Int. Cl.[5] ..... C22C 38/12; C22C 38/06

[52] U.S. Cl. ..... 420/105; 148/334; 148/909; 138/177; 219/61

[58] Field of Search ..... 420/105; 148/909, 334; 138/177, DIG. 6; 219/61, 60.2

[56] References Cited

U.S. PATENT DOCUMENTS 4,804,021 2/1989 Hasegawa et al. ..... 148/334

5,213,633 5/1993 Hada et al. ..... 148/334

FOREIGN PATENT DOCUMENTS 91226455 8/1981 Japan .

OTHER PUBLICATIONS

Toshimi Matsumoto et al, "Reduction of Carbon Content and Provemention of Weld Cracking in 1¼Cr-½Mo Steel", The Quarterly Journal of the Japan Welding Society, vol. 3, No. 2, 1985, pp. 135-143.

*Primary Examiner*—Deborah Yee

*Attorney, Agent, or Firm*—Frishauf, Holtz, Goodman & Woodward

[57] ABSTRACT

A Cr-Mo steel pipe having a wall thickness of 5 to 25 mm consisting essentially of 0.03 to 0.10 wt. % C, 0.5 to 1.0 wt. % Si, 0.3 to 0.6 wt. % Mn, 0.02 wt. % or less P, 0.007 wt. % or less S, 1.0 to 1.5 wt. % Cr, 0.45 to 0.65 wt. % Mo, 0.002 to 0.1 wt. % Al, 0.002 to 0.01 wt. % N, and the balance being Fe and unavoidable impurities. In the method of welding the Cr-Mo steel pipe, the Cr-Mo steel pipe is welded by shielded metal arc welding without a preheat treatment and/or a post weld heat treatment.

15 Claims, 7 Drawing Sheets

CR-MO STEEL PIPE AND WELDING METHOD THEREOF

BACKGROUND OF THE INVENTION

1. Field of the Invention

The present invention relates to a Cr-Mo steel pipe and a welding method thereof and, more particularly, to a steam pipe used for electric power plants or others and the welding method thereof.

2. Description of the Related Art

A 1.25Cr-0.5Mo steel pipe is heavily hardened by welding. Therefore, a preheat treatment and post weld heat treatment are required in welding such type of steel pipes to reduce the hardness and prevent cold cracking in welding and stress corrosion cracking in use. A preheat treatment is needed for preventing the formation of weld cracks. A post weld heat treatment to 500°–700° C. is indispensable for increasing the absorbed energy in a Charpy impact test at room temperature to 10–15 kg.m because the absorbed energy of a 1.25Cr-0.5Mo steel pipe is about 2–3kg.m.

The Quarterly Journal of the Japan Welding Society Vol.3, No.2 issued in 1985 described on its page 371 that a) steel pipes containing C, Mn, Ni, Cr and Mo of certain amounts should be preheated to a temperature below 100 ° C. when they are subjected to shielded metal arc welding, b) preheated to a temperature over 225° C. without a post weld heat treatment when subjected to multi-layer shielded metal arc welding, and the interpass temperature should be above 225 ° C. Similar facts have been disclosed in Japanese Patent Laid-Open No.56309/1986.

HLPS, stress-relief annealing standard and its explanation describe that a post weld heat treatment is eliminated for pipes with a small wall thickness, when the standard components of SCMV3, STPA23, and STBA23 are preheated to 150° to 300° C. keeping the interpass temperature at 50° to 300 ° C.

SCMV3 is stated in JIS (Japanese Industrial Standard) specification referring to a pressure vessel. STPA23 consists of C of 0.17 wt. % or less, Si of 0.44 to 0.86 wt. %, Mn of 0.36 to 0.69 wt. %, P of 0.030 wt. % or less, S of 0.030 wt. % or less, Cr of 0.94 to 1.56 wt. %, Mo of 0.40 to 0.70 wt. %.

STPA23 is a letter symbol of grade for alloy steel pipe stated in JISG3458, which consists of C of 0.15 wt. % or less, Si of 0.50 to 1.00 wt. %, Mn of 0.30 to 0.60 wt. %, P of 0.030 wt. % or less, S of 0.0301.% or less, Cr of 1.00 to 1.50 wt. %, Mo of 0.45 to 0.65 wt. %. STBA23 is a letter symbol of a grade for alloy steel boiler and heat exchanger tubes stated in JISG3462, which consists of C of 0.15 wt. % or less, Si of 0.50 to 1.00 wt. %, Mn of 0.30 to 0.60 wt. %, P of 0.030 wt. % or less, S of 0.030 wt. % or less, Cr of 1.00 to 1.50 wt. %, Mo of 0.45 to 0.65 wt. %.

As described above, 1.25Cr-0.5Mo steel easily develops cold cracking in welding because its heat-affected zone is heavily hardened. To prevent the cracking, it is necessary to perform a preheat treatment to a temperature of 150° to 350° C. to reduce the thermal stress in welding and to decrease the amount of diffusible hydrogen which causes cracking.

In most cases, a post weld heat treatment to a temperature of 600° to 700 ° C. is required to soften the heat-affected zone, remove the residual hydrogen, restore the toughness, and prevent stress corrosion cracking. These heat treatments are troublesome and disadvantageous in terms of work cost and work period. Also, they are unfavorable for quality control.

SUMMARY OF THE INVENTION

The object of this invention is to provide a Cr-Mo steel pipe that requires no preheat treatment and post weld heat treatment for welding and welding method thereof. To achieve the object, this invention provides a Cr-Mo steel pipe which consists of C of 0.03 to 0.10 wt. %, Si of 0.5 to 1.0 wt. %, Mn of 0.3 to 0.6 wt. %, P of 0.02 wt. % or less, S of 0.007 wt. % or less, Cr of 1.0 to 1.5%, Mo of 0.45 to 0.65%, At of 0.002 to 0.01 wt. %, N of 0.002 to 0.01 wt. %, and the balance of Fe and inevitable impurities; and said Cr-Mo steel pipe having a wall thickness of 5 to 25 mm.

This invention also provides a method for welding a Cr-Mo steel pipe comprising the steps of:

Preparing a steel pipe which consists of C of 0.03 to 0.10 wt. %, Si of 0.5 to 1.0 wt. %, Mn of 0.3 to 0.6 wt. %, P of 0.02 wt. % or less, S of 0.007 wt. % or less, Cr of 1.0 to 1.5 wt. %, Mo of 0.45 to 0.65 wt. %, AI of 0.002 to 0.01 wt. %, N of 0.002 to 0.001 wt. %, and the balance of Fe and unavoidable impurities, and has a wall thickness of 5 to 25mm or less; and welding said steel pipe by shielded metal arc welding without a preheat treatment and or a post weld heat treatment.

DESCRIPTION OF THE PREFERRED EMBODIMENT

Figure 1:
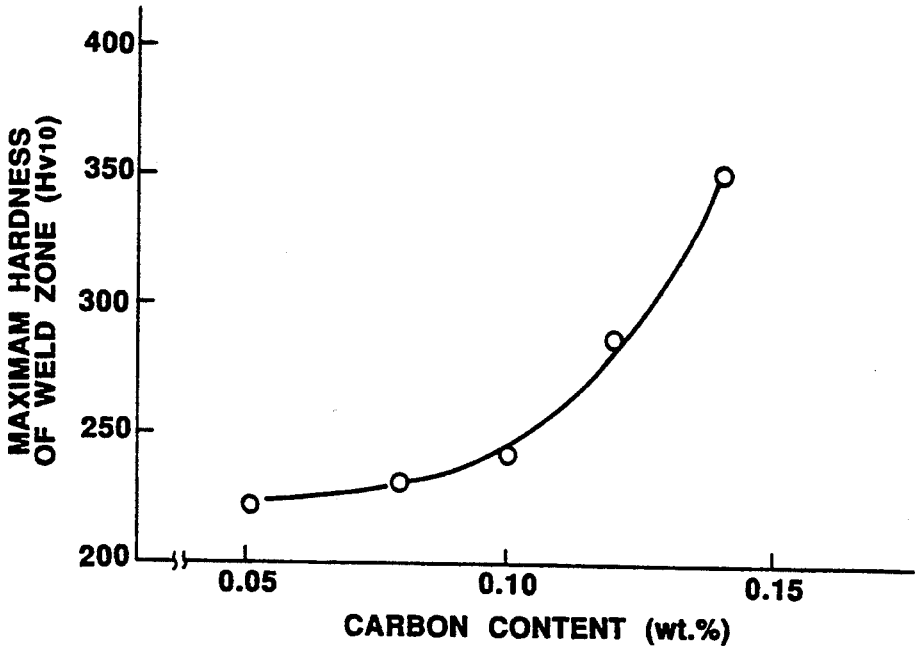
FIG. 1 shows the relationship between the maximum hardness of the weld and the C content in accordance with the present invention.

The reason why the chemical composition range is limited will be described below.

C: 0.03 to 0.10 wt. %

C is an element which affects cold cracking and hardness of the weld zone most remarkedly. The upper limit of the content of C is set at 0.10 wt. % to prevent the formation of cracks and the decrease in hardness. The lower limit is set at 0.03wt. % to maintain the strength of material. C of 0.06 to 0.10 wt. % is the most preferable contents range.

Si: 0.50 to 1.0 wt. %

Si of 0.50 wt. % or more is required as a deoxidizer. The upper limit is set at 1.00 wt. % to provide high toughness. Si of 0.6 to 0.8 wt. % is the most preferable content range.

Mn: 0.30 to 0.60 wt. %

Mn is necessary for maintaining strength at normal temperature. For this purpose, a content of Mn less than 0.30 wt. % is insufficient. On the other hand, when the content of Mn exceeds 0.6 wt. %, the effect does not increase and disadvantages are noticed. Therefore, the content range is limited to 0.30 to 0.60 wt. %. Mn of 0.35 to 0.5 wt. % is the most preferable content.

P: 0.020 wt. % or less

The upper limit of P content must be set at 0.02 at the most to reduce surface flaws on seamless pipes. P of 0.05 to 0.02 wt. % is the most preferable content range.

S: 0.007 wt. % or less

The upper limit of S content must be set at 0.007 wt. % to obtain a welded joint with high toughness in an as-welded state without a post weld heat treatment. S of 0.001 to 0.007 wt. % is the most preferable content range.

Cr: 1.00 to 1.50 wt. %

Cr is an element which is indispensable to maintain corrosion resistance, and a content of Cr of 1.00 wt. % or more is needed. The content range must be set at 1.00 to 1.50 wt. % to properly provide the corrosion resistance and the strength at high temperatures. Cr of 1.1 to 1.3 wt. % is the most preferable content range.

Al: 0.002 to 0.010 wt. %

A1 increases the oxidation resistance. For this purpose, a content of 0.002 wt. % or more is required. On the other hand, a high content of A1 impairs the workability and decreases the creep strength. Therefore, the upper limit is set at 0.010 wt. %. A1 of 0.002 to 0.01 wt. % is the most preferable content range.

N: 0.002 to 0.010 wt. %

N of 0.002 wt. % or more must be contained to provide strength at high temperatures with solid solution strengthening. This effect does not increase when the content of N is over 0.010 wt. %. Therefore, the upper limit is set at 0.010%.

Mo: 0.45 to 0.65 wt. %

Mo is essential to maintain the strength at high temperatures. For this purpose, Mo of 0.45 wt. % or more must be contained. When the Mo content exceeds 0.60 wt. %, the weldability is deteriorated. Therefore, the upper limit is set at 0.60 wt. %. Mo of 0.55 to 0.55 wt. % is the most preferable content range.

The steel pipe of the present invention having the above-described chemical composition must have a wall thickness of 25 mm or less, such as 13 mm or less. In welding, as the wall thickness of pipe increases, the cooling rate in the weld thermal cycle increases, which increases the hardness of weld. To obtain a specified hardness such as 250 Hv or less, the wall thickness must be 25 mm or less.

Weld cracks are formed by a restraint stress developed during welding, and the restraint stress is proportional to the wall thickness of the joint. Therefore, in order to prevent the occurrence of excessive restraint stress at the joint, the wall thickness of pipe must be limited to 25 mm or less.

EXAMPLE

A concrete example of the present invention will be described below. FIG. 1 shows the relationship between the maximum hardness of the weld and the C content. The result was obtained by welding steel pipes by multi-layer shielded metal arc welding. This figure clearly indicates that the maximum hardness of 250 Hv or less can be properly obtained when the C content is 0.10% or less.

Steel pipe: 250A×12.7min.

Steel pipe: the composition described in Table 1.

Welding material: DT2315, 4 mmϕ defined in JISZ3223.

Welding method: shielded metal are welding, 170A×24V×15 cm/min.

DT2315 consists of C of 0.05 wt. % or less, Si of 1.00 wt. % or less, Mn of 0.90 wt. % or less, P of 0.040 wt. % or less, S of 0.040 wt. % or less, Cr of 1.00 to 1.50 wt. %, Mo of 0.40 to 0.65 wt. %.

TABLE 1

| Steel pipe | C | Si | Mn | P | S | Cr | Mo | Al | N |
|---|---|---|---|---|---|---|---|---|---|
| A | 0.08 | 0.70 | 0.40 | 0.013 | 0.006 | 1.23 | 0.48 | 0.004 | 0.006 |
| B | 0.10 | 0.73 | 0.48 | 0.011 | 0.004 | 1.28 | 0.52 | 0.006 | 0.007 |
| C | 0.06 | 0.75 | 0.48 | 0.010 | 0.004 | 1.18 | 0.47 | 0.005 | 0.007 |
| D | 0.06 | 0.73 | 0.47 | 0.011 | 0.005 | 1.15 | 0.51 | 0.006 | 0.004 |
| E | 0.10 | 0.64 | 0.45 | 0.009 | 0.006 | 1.25 | 0.48 | 0.003 | 0.005 |
| F | 0.08 | 0.72 | 0.41 | 0.012 | 0.003 | 1.20 | 0.47 | 0.007 | 0.005 |
| G | 0.07 | 0.73 | 0.44 | 0.013 | 0.005 | 1.20 | 0.52 | 0.005 | 0.006 |
| H | 0.12 | 0.75 | 0.51 | 0.016 | 0.006 | 1.31 | 0.55 | 0.005 | 0.006 |
| I | 0.14 | 0.75 | 0.60 | 0.015 | 0.005 | 1.37 | 0.51 | 0.007 | 0.008 |

Figure 2:
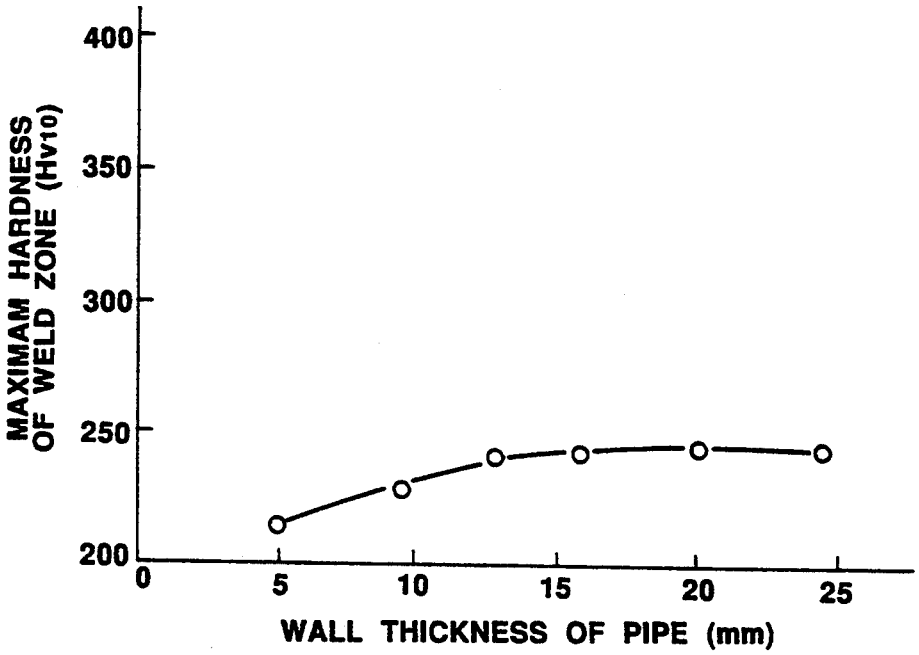
FIG. 2 shows the relationship between the maximum hardness of the weld and the wall thickness of pipe in accordance with the present invention.

FIG. 2 shows the relationship between the maximum hardness of the weld and the wall thickness. The result was obtained by welding pipes under the above-described welding conditions. The maximum hardness of 250 Hv or less can be obtained when the wall thickness is 25 mm or less. The most preferable wall thickness is 5 to 25 mm.

Figure 3:
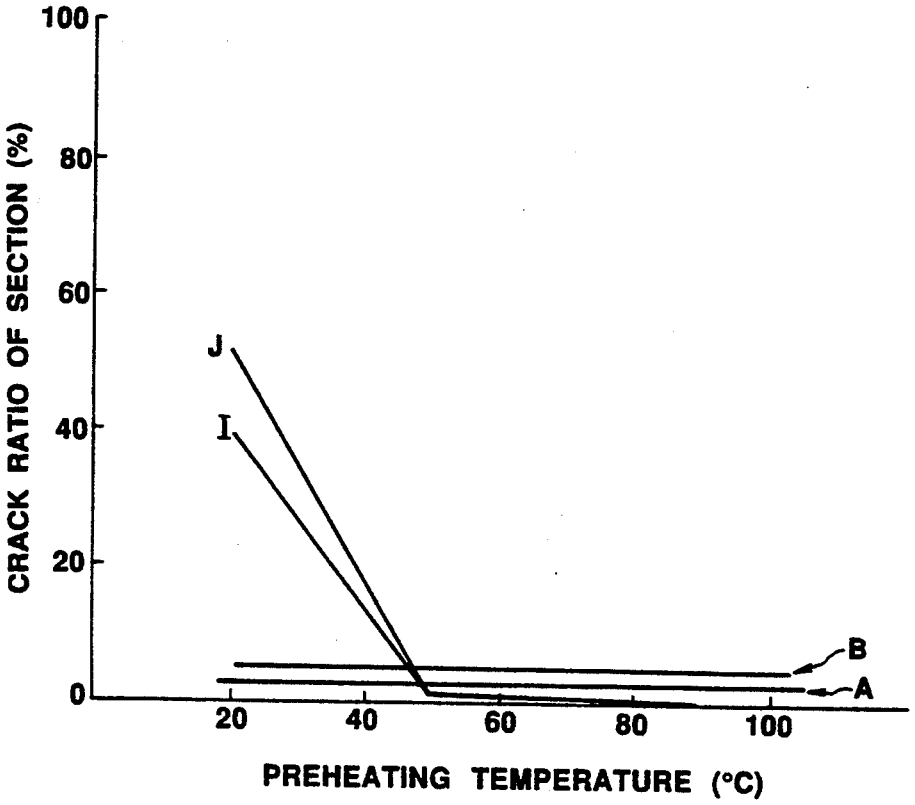
FIG. 3 shows the result of a y-groove cracking test on test pieces in accordance with the present invention.

A y-groove weld cracking test was performed to investigate the weld cracks, the results of which are shown in FIG. 3. The preheating temperature is represented on the abscissa and the crack ratio of a section is represented on the ordinate. In the y-groove weld cracking test, the steel pipe A and B with contents which are within the range of the present invention do not develop cracks of a section when the preheating temperature is 20° C., or without preheat treatment. On the other hand, the steel pipe I and J with contents which are outside the range of the present invention develops cracks of a section when the preheating temperature is 50° C. or less.

Figure 4A:
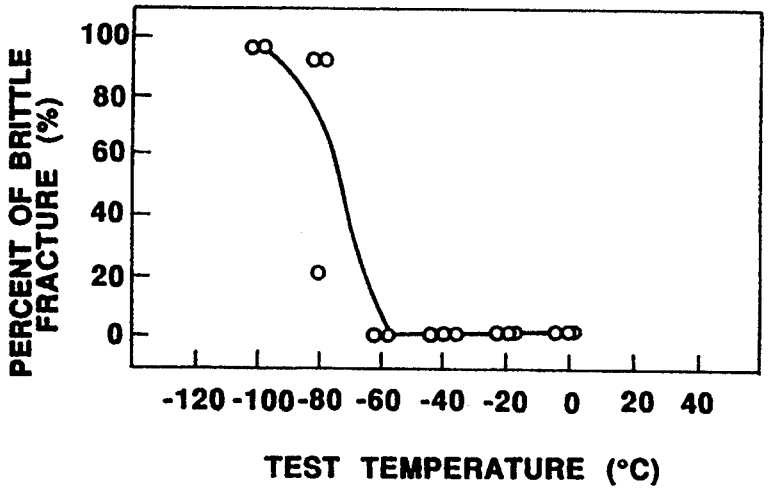
FIGS. 4(A)–4(B) show the results of an impact test applied to a steel pipe in accordance with the present invention.
Figure 4B:
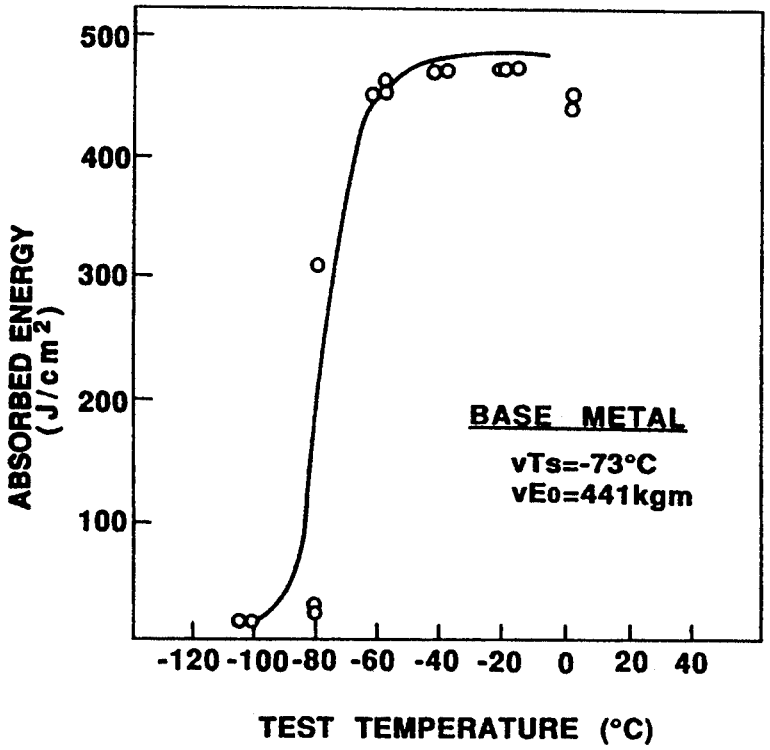

A 250A×9.5t steel pipe was produced with a steel having a chemical composition given in Table 2 and the mechanical properties which are given in Table 3, and an impact test was made on that steel pipe. The test method is the Charpy impact test, and the test piece is 7.5 mm×10 mm, V-notch. The result are shown in FIG. 4(A) and FIG. 4(B). It was confirmed that the steel pipe of the present invention has sufficient strength and toughness.

TABLE 2

| C | Si | Mn | P | S | Cr | Mo | Al | N |
|---|---|---|---|---|---|---|---|---|
| 0.08 | 0.70 | 0.40 | 0.014 | 0.003 | 1.20 | 0.48 | 0.005 | 0.006 |

TABLE 3

| Tensile strength ($N/mm^2$) | Proof stress ($N/mm^2$) | Elongation (%) |
|---|---|---|
| 472 | 360 | 43 |

Figure 5:
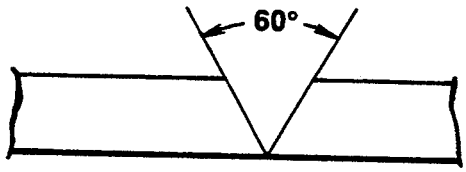
FIG. 5 shows a sectional view of a V-shaped groove used in testing the joint properties.

To investigate the joint performance, a 3 to 5 layer shielded metal arc welding was performed at a 60° V groove as shown in FIG. 5. The welding conditions are given in Table 4. Neither preheat treatment nor a post weld heat treatment was performed.

TABLE 4

| Welding material | Current | Voltage | Velocity |
|---|---|---|---|
| DT2315,4$\phi$ | 170 A | 24 A | 15 cm/min |

TABLE 5

| Tensile strength ($N/mm^2$) | Position of fracture |
|---|---|
| 510 | Base metal |
| 510 | Base metal |

TABLE 6

| Notch position | Transition temperature (°C.) | Impact value at 0° C. (J/cm) |
|---|---|---|
| Base material | −73 | 441 |
| HAZ | −20 | 270 |
| Weld metal | −10 | 285 |

Figure 6:
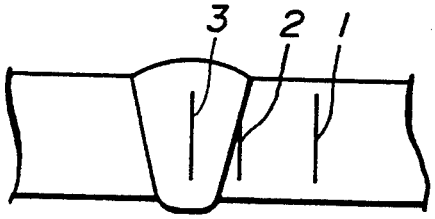
FIG. 6 shows the measurement positions in a Charpy impact test.
Figure 7A:
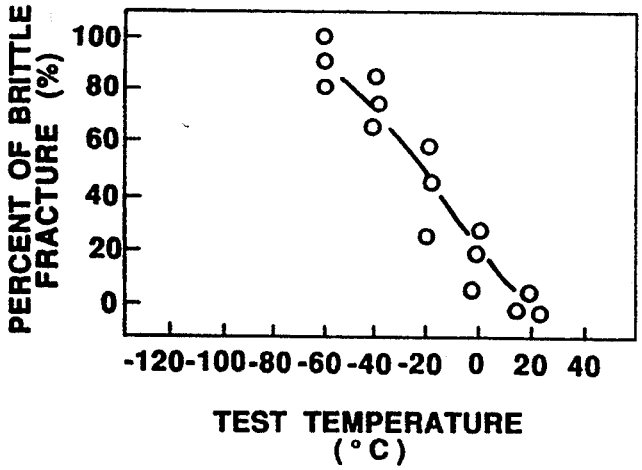
FIGS. 7(A), 7(B), 7(C) and 7(D) show the measurement results of absorbed energy and percent brittle, fracture in accordance with the present invention.
Figure 7B:
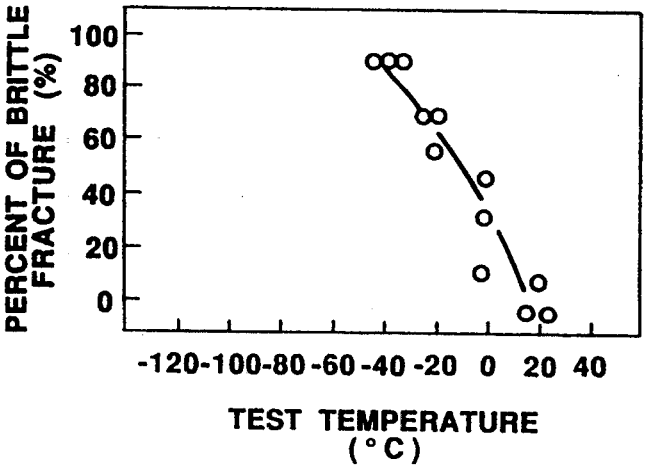
Figure 7C:
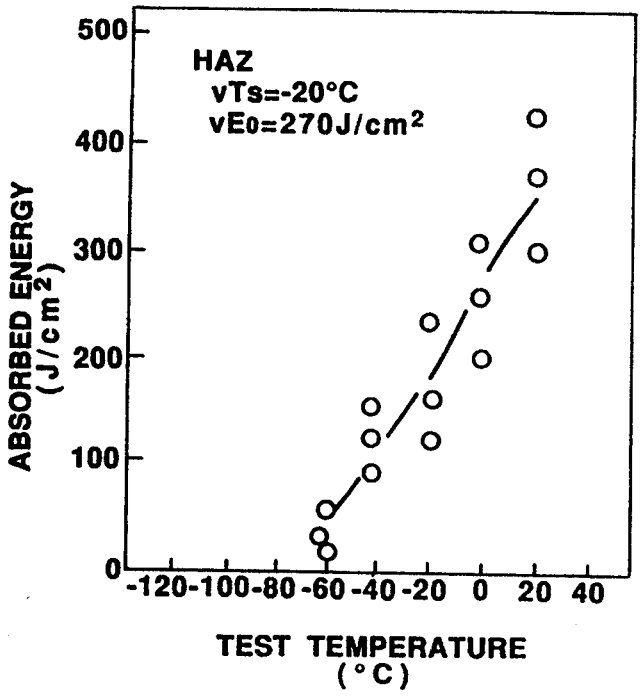
Figure 7D:
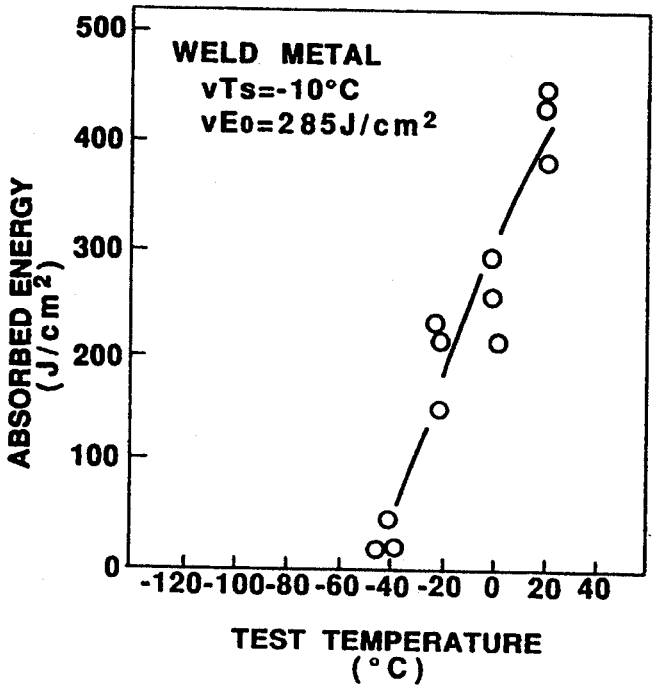

Table 5 gives the result of a tensile test of a joint, and Table 6 gives the result of an impact test of a joint. In the impact test, 7.5t×10w test pieces with a V notch were used. The test pieces were cut out from the positions of weld metal center, boundary portion, and heat-affected zone as shown in FIG. 6. All of base metal, heat-affected zone (HAZ), and weld metal of the pipe of the present invention had a satisfactory impact property. The absorbed energy and the percent brittle fracture are shown in FIGS. 7(A), 7(B), 7(C) and 7(D).

Figure 8A:
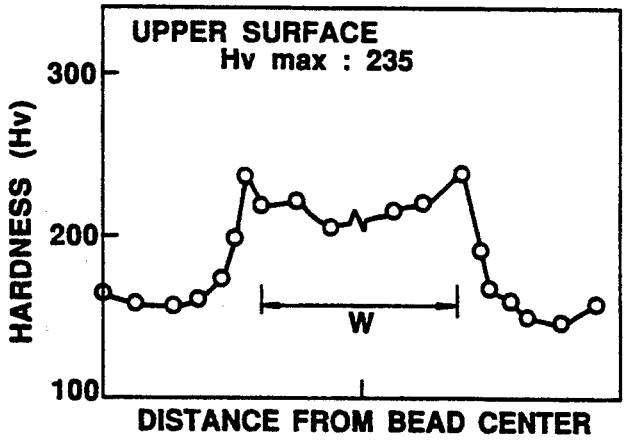
FIGS. 8(A)–8(C) show the measurement results of hardness at positions of upper surface, center, and lower surface of the joint in accordance with the present invention.
Figure 8B:
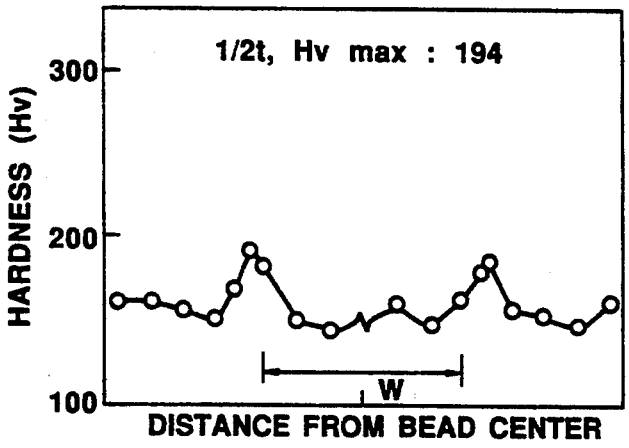
Figure 8C:
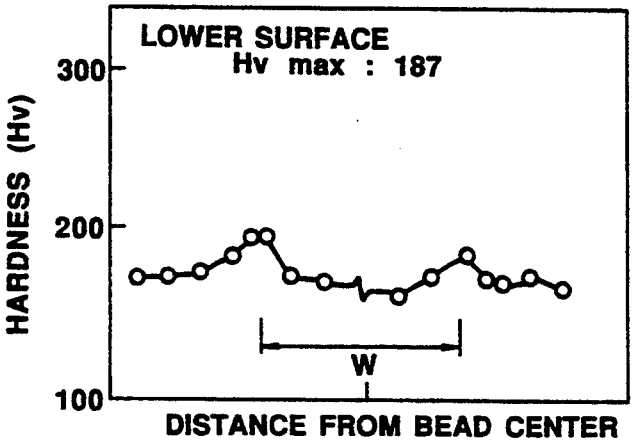

FIG. 8 shows the distribution of hardness at the joint. Vickers hardness tests (load: 10 kgf) were performed at positions 2 mm under the upper surface, at the center of the wall, and 2 mm over the lower surface of the pipe. The hardness was measured at intervals of 1.0 mm for base metal and weld metal, and 0.5 mm at HAZ. The hardness was under 250 Hv for all measurement positions.

According to the present invention described above, weld cracks can be prevented, hardness of weld under 250 Hv can be obtained, and stress corrosion cracking in use can be avoided without a preheat treatment and a post weld heat treatment and also without the specification of inter pass temperature. In addition, the joint toughness and other properties are superior to those of conventional pipe which is preheated and postheated. Therefore, the present invention is an industrially effective invention.

What is claimed is:

1. A Cr-Mo steel pipe having a wall thickness of 5 to 25 mm, said steel pipe consisting essentially of C of 0.03 to 0.10 wt. %, Si or 0.5 to 1.0 wt. %, Mn of 0.3 to 0.6 wt. %, P of 0.02 wt. %, or less, S of 0.007 wt. % or less, Cr of 1.0 to 1.5 wt. %, Mo of 0.45 to 0.65 wt. %, Al of 0.002 to 0.01 wt. %, N of 0.002 to 0.01 wt. %, and the balance being Fe and unavoidable impurities.

2. The Cr-Mo steel pipe of claim 1, wherein said C wt. % is 0.06 to 0.1 wt. %.

3. The Cr-Mo steel pipe of claim 1, wherein said Si wt. % is 0.6 to 0.8 wt. %.

4. The Cr-Mo steel pipe of claim 1, wherein said Mn wt. % is 0.35 to 0.5 wt. %.

5. The Cr-Mo steel pipe of claim 1, wherein said Cr wt. % is 1.1 to 1.3 wt. %.

6. The Cr-Mo steel pipe of claim 1, wherein said Mo wt. % is 0.45 to 0.55 wt. %.

7. A Cr-Mo steel pipe having a wall thickness of 5 to 25 mm, said steel pipe consisting essentially of C of 0.06 to 0.1 wt. %, Si or 0.6 to 0.8 wt. %, Mn of 0.35 to 0.5 wt. %, P of 0.005 wt. %, to 0.02 wt. %, S of 0.001 to 0.007 wt. %, Cr of 1.1 to 1.3%, Mo of 0.45 to 0.55%, Al of 0.002 to 0.01 wt. %, N of 0.002 to 0.01 wt. %, and the balance being Fe and unavoidable impurities.

8. A method for welding a Cr-Mo steel pipe comprising the steps of:

preparing a steel pipe having a wall thickness of 5 to 25 mm which consisting essentially of C of 0.03 to 0.10 wt. %, Si or 0.5 to 1.0 wt. %, Mn of 0.3 to 0.6 wt. %, P of 0.02 wt. %, or less, S of 0.007 wt. % or less, Cr of 1.0 to 1.5 wt. %, Mo of 0.45 to 0.65 wt. %, Al of 0.002 to 0.01 wt. %, N of 0.002 to 0.01 wt. %, and the balance being Fe and unavoidable impurities; and welding said steel pipe by shielded metal arc welding without carrying out preheat treating and/or post weld heat treating.

9. The Cr-Mo steel pipe of claim 2, wherein said Si wt. % is 0.6 to 0.8 wt. %.

10. The Cr-Mo steel pipe of claim 9, wherein said Mn wt. % is 0.35 to 0.5 wt. %.

11. The Cr-Mo steel pipe of claim 9, wherein said Cr wt. % is 1.1 to 1.3 wt. %.

12. The Cr-Mo steel pipe of claim 1, wherein the steel pipe has a composition selected from the group consisting essentially of:

(a) 0.08 wt. % C, 0.70 wt. % Si, 0.40 wt. % Mn, 0.013 wt. % P, 0.006 wt. % S, 1.23 wt. % Cr, 0.48 wt. % Mo, 0.004 wt. % Al, 0.006 wt. % N;

(b) 0.10 wt. % C, 0.73 wt. % Si, 0.48 wt. % Mn, 0.011 wt. % P, 0.004 wt. % S, 1.28 wt. % Cr, 0.52 wt. % Mo, 0.006 wt. % Al, 0.007 wt. % N;

(c) 0.06 wt. % C, 0.75 wt. % Si, 0.48 wt. % Mn, 0.010 wt. % P, 0.004 wt. % S, 1.18 wt. % Cr, 0.47 wt. % Mo, 0.005 wt. % Al, 0.007 wt. % N;

(d) 0.06 wt. % C, 0.73 wt. % Si, 0.47 wt. % Mn, 0.011 wt. % P, 0.005 wt. % S, 1.15 wt. % Cr, 0.51 wt. % Mo, 0.006 wt. % Al, 0.004 wt. % N;

(e) 0.10 wt. % C, 0.64 wt. % Si, 0.45 wt. % Mn, 0.009 wt. % P, 0.006 wt. % S, 1.25 wt. % Cr, 0.48 wt. % Mo, 0.003 wt. % Al, 0.005 wt. % N;

(f) 0.08 wt. % C, 0.72 wt. % Si, 0.41 wt. % Mn, 0.012 wt. % P, 0.003 wt. % S, 1.20 wt. % Cr, 0.47 wt. % Mo, 0.007 wt. % Al, 0.005 wt. % N;

(g) 0.07 wt. % C, 0.73 wt. % Si, 0.44 wt. % Mn, 0.013 wt. % P, 0.005 wt. % S, 1.20 wt. % Cr, 0.52 wt. % Mo, 0.005 wt. % Al, 0.006 wt. % N;

(h) 0.12 wt. % C, 0.75 wt. % Si, 0.51 wt. % Mn, 0.016 wt. % P, 0.006 wt. % S, 1.31 wt. % Cr, 0.55 wt. % Mo, 0.005 wt. % Al, 0.006 wt. % N, and (i) 0.14 wt. % C, 0.75 wt. % Si, 0.60 wt. % Mn, 0.015 wt. % P, 0.005 wt. % S, 1.37 wt. % Cr, 0.51 wt. % Mo, 0.007 wt. % Al, 0.008 wt. % N, the balance of each of compositions (a) to (i) being Fe and inevitable impurities.

13. The method of claim 8, wherein the Cr-Mo steel pipe consists essentially of C of 0.06 to 0.1 wt. %, Si of 0.6 to 0.8 wt. %, Mn of 0.35 to 0.5 wt. %, P of 0.005 to 0.02 wt. %, S of 0.001 to 0.007 wt. %, Cr of 1.1 to 1.3%, Mo of 0.45 to 0.55%, Al of 0.002 to 0.01 wt. %, N of 0.002 to 0.01 wt. %, and the balance being Fe and unavoidable impurities.

14. The method of claim 8, wherein the Cr-Mo steel pipe has a composition selected from the group consisting essentially of:

(a) 0.08 wt. % C, 0.70 wt. % Si, 0.40 wt. % Mn, 0.013 wt. % P, 0.006 wt. % S, 1.23 wt. % Cr, 0.48 wt. % Mo, 0.004 wt. % Al, 0.006 wt. % N;

(b) 0.10 wt. % C, 0.73 wt. % Si, 0.48 wt. % Mn, 0.011 wt. % P, 0.004 wt. % S, 1.28 wt. % Cr, 0.52 wt. % Mo, 0.006 wt. % Al, 0.007 wt. % N;

(c) 0.06 wt. % C, 0.75 wt. % Si, 0.48 wt. % Mn, 0.010 wt. % P, 0.004 wt. % S, 1.18 wt. % Cr, 0.47 wt. % Mo, 0.005 wt. % Al, 0.007 wt. % N;

(d) 0.06 wt. % C, 0.73 wt. % Si, 0.47 wt. % Mn, 0.011 wt. % P, 0.005 wt. % S, 1.15 wt. % Cr, 0.51 wt. % Mo, 0.006 wt. % Al, 0.004 wt. % N;

(e) 0.10 wt. % C, 0.64 wt. % Si, 0.45 wt. % Mn, 0.009 wt. % P, 0.006 wt. % S, 1.25 wt. % Cr, 0.48 wt. % Mo, 0.003 wt. % Al, 0.005 wt. % N;

(f) 0.08 wt. % C, 0.72 wt. % Si, 0.41 wt. % Mn, 0.012 wt. % P, 0.003 wt. % S, 1.20 wt. % Cr, 0.47 wt. % Mo, 0.007 wt. % Al, 0.005 wt. % N;

(g) 0.07 wt. % C, 0.73 wt. % Si, 0.44 wt. % Mn, 0.013 wt. % P, 0.005 wt. % S, 1.20 wt. % Cr, 0.52 wt. % Mo, 0.005 wt. % Al, 0.006 wt. % N;

(h) 0.12 wt. % C, 0.75 wt. % Si, 0.51 wt. % Mn, 0.016 wt. % P, 0.006 wt. % S, 1.31 wt. % Cr, 0.55 wt. % Mo, 0.005 wt. % Al, 0.006 wt. % N, and (i) 0.14 wt. % C, 0.75 wt. % Si, 0.60 wt. % Mn, 0.015 wt. % P, 0.005 wt. % S, 1.37 wt. % Cr, 0.51 wt. % Mo, 0.007 wt. % Al, 0.008 wt. % N, the balance of each of compositions (a) to (i) being Fe and inevitable impurities.

15. The method of claim 8, wherein the wall thickness is 5 to 13 mm.

* * * * *